United States Patent [19]

Storrie et al.

[11] 4,156,950

[45] Jun. 5, 1979

[54] CULVERT CLEANOUT DEVICE

[76] Inventors: Robert C. Storrie, 215 E. Hickory; Rufus T. Coffey, 724 Chisholm Trail, both of Denton, Tex. 76201

[21] Appl. No.: 868,405

[22] Filed: Jan. 10, 1978

[51] Int. Cl.[2] ..... B08B 9/02

[52] U.S. Cl. ..... 15/104.3 R

[58] Field of Search ..... 15/104.3 R

[56] References Cited

U.S. PATENT DOCUMENTS

| | | | |
|---|---|---|---|
| 402,908 | 5/1889 | Donnelly et al. | 15/104.3 R |
| 1,110,832 | 9/1914 | Shirk | 15/104.3 R |
| 1,263,733 | 4/1918 | Bassett | 15/104.3 R |
| 1,498,446 | 6/1924 | Geskey | 15/104.3 R |
| 2,278,026 | 3/1942 | Smith | 15/104.3 R |

*Primary Examiner*—Edward L. Roberts

*Attorney, Agent, or Firm*—Gerald G. Crutsinger; Larry B. Dwight

[57] ABSTRACT

Apparatus to clean out a culvert used under a road where an open ditch intersects the road to break up and remove the dirt and debris which has settled within the culvert. The device comprises three equally spaced arms having a recess formed in the central portion thereof to reduce the surface area of the arms and a downwardly extending rudder formed in the central portion thereof to aid in breaking up the center of the bottom portion of the dirt within the culvert. The disc may be removeably attached to the device such that after the dirt is broken up, the disc is used to pull the dirt from the culvert. The device is pulled from the upper portion of the end closest to the direction of travel by a cable attached thereto which is extended through the culvert.

10 Claims, 7 Drawing Figures

CULVERT CLEANOUT DEVICE

BACKGROUND

This invention relates to a device for breaking up dirt and gravel within a culvert and the removal of the dirt from the culvert. Several types of culverts are used under roads where a stream or drainage ditch bridges the road. The culvert generally comprises either a concrete conduit buried under the road or a galvanized tin structure generally called a tinhorn which is buried under the road. After many rains, the dirt is washed from the open ditch into the culvert which fills up with dirt and gravel and other debris.

Heretofore, one of the methods used to clean the culvert out was to close the road and dig up the pavement. Gravel had to be removed and then the culvert was removed and cleaned by hand in a separate location. The culvert had to be replaced, the gravel placed around it, the road filled and pavement had to be replaced. This generally takes one to one and a half days depending upon the type of pavement used over the culvert.

Other methods used to clean out the culverts has generally included hydraulics wherein a long conduit having jets which point forward at the tip and several jets pointing backwards to pull the soil back along the hole. However, this requires considerable amount of time and water and creates a hugh mess. Further the hydraulic method only cleans a small hole so that the water can continue through and hopefully will wash out the balance of the dirt once a small hole has been formed therein.

Once the dirt has become compacted with gravel and other debris within the culvert it becomes very dense and hard to remove. Any attempt to remove all the dirt at one time is generally unsuccessul because the culvert will be pulled from the ground or the disc will be deformed or cable attached to the device will snap in half because of the forces developed by the huge amount of dirt and the resistance offered thereby.

SUMMARY

I have devised a device to clean out concrete and metal culverts which are compacted and filled with dirt, gravel and other debris. The device briefly comprises three spaced arms extending radially outwardly from the center axis. Each of the arms comprises a flat plate having a recess in the central portion thereof to reduce the surface area of the arms. The two lower arms support the device on the bottom of the culvert and a center rudder extends downwardly from the central portion between said lower arms and is shorter than said arms to break up the dirt in the center of the culvert. The device is pulled from the upper portion of the upper arm by a chain or cable. After the device has been drawn through a culvert to break up the dirt a disc is placed in a slotted hole formed in the rear portion of the device to pull the dirt from the culvert.

The arms preferably have ribs formed on the outer edges thereof to prevent the device from cutting metal culverts.

A primary object of the invention is to provide a device which will break up the debris in a culvert to allow removal of the debris without the necessity of digging up the culvert to clean same out.

A further object of the invention is to provide a culvert cleanout device which minimizes time required to clean out the culvert and reduces the necessity of closing the road to traffic in order to perform the cleanout operation.

A still further object of the invention is to provide a simple apparatus which can be readily used with any prime mover by anyone, i.e. a farmer, a city engineer, construction engineers, and workmen who find it necessary to clean out a culvert under a road.

Other and further objects of the invention will become apparent upon a study of the detailed description hereinafter following and by referring to the drawings annexed hereto.

BRIEF DESCRIPTION OF THE DRAWING

Drawings of a preferred embodiment of the invention are annexed hereto so that the invention may be better and more fully understood, in which.

Numeral references are used to designate like parts throughout the various figures of the drawings.

BRIEF DESCRIPTION OF A PREFERRED EMBODIMENT

Figure 3:
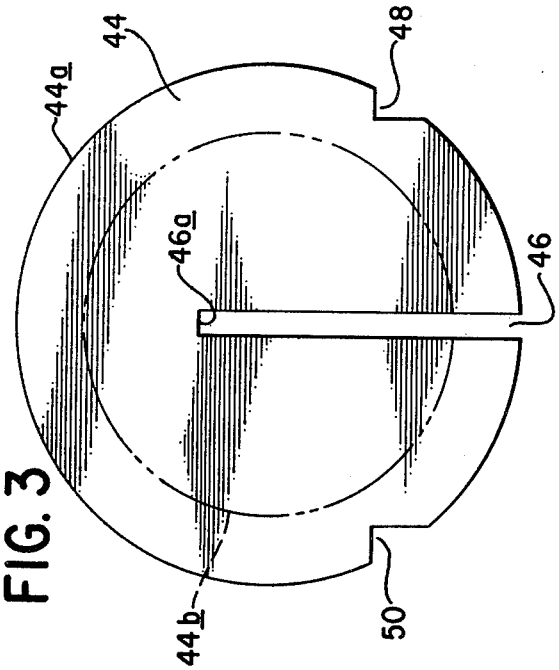
FIG. 3 is an elevational view of the cleanout disc.

Referring to the drawings, numeral 10 generally refers to the culvert cleanout device as best illustrated in FIGS. 1, 2, 4 and 5.

Figure 5:
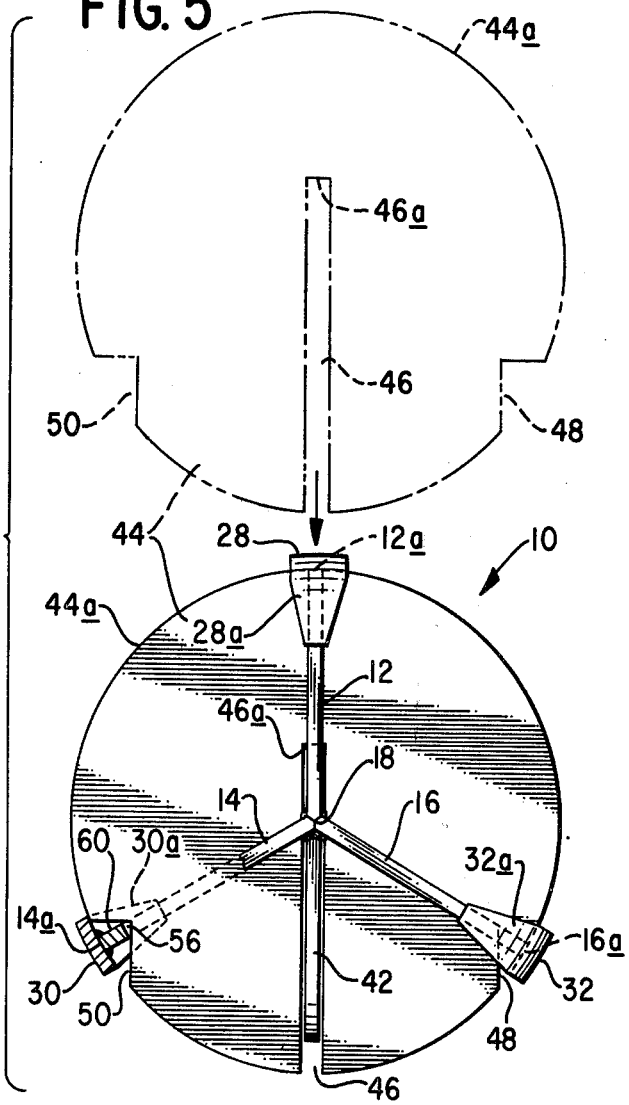
FIG. 5 is an end view of the cleanout device showing a disc in dashed outline as it is being placed on a device.

As illustrated in FIG. 5, the device generally comprises three equally spaced radially extending arms 12, 14, and 16 which are welded or otherwise secured at a central point which forms the longitudinal axis 18.

Arm 12 is preferably oriented in a generally vertical position and arms 14 and 16 are spaced approximately 120 degrees from arm 12 and engage the lower inner surface of the culvert 20 when placed therein.

Each of the arms 12, 14 and 16 has a recess 22,24, and 26 cut from the central portion inward from the outer edge of the arms. The recesses 22, 24, and 26 reduce the surface area of the arms 12, 14 and 16 to reduce the friction of the dirt and mud on the device 10 as it is pulled through the culvert. Flat ribs 28, 30 and 32 are welded or otherwise secured on the outer edges 12*a*, 14*a*, and 16*a* of each end of arms 12, 14 and 16. The ends 28*a* and 28*b* of rib 28, ends 30*a* and 30*b* of rib 30, and ends 32*a* and 32*b* of rib 32 are deflected inwardly toward the central axis 18 of the culvert cleanout device 10 to prevent edges 12*a*, 14*a*, and 16*a* from damaging the inner wall 20*a* of culvert 20.

Means to move the culvert cleanout device 10 through culvert 20 comprises a cable 34 secured to a prime mover (not shown) such as a tractor, pickup truck or other suitable vehicle. The cable 34 is secured to a shackle 36 which is secured in one of the holes 38 and 40 formed on each end of the cleanout device 10. If the shackle 36 is secured in the lower hole 40 the device will tend to have an upward movement within the culvert 20 and if the shackle 36 is secured in the upper hole 38 the top will be pulled down causing the arms 14 and 16 to dig into the soil. A cable 65 should be attached to the other end by using an additional shackle 36 such that the device may be pulled from one end of the culvert 20 to the other and back again.

Figure 7:
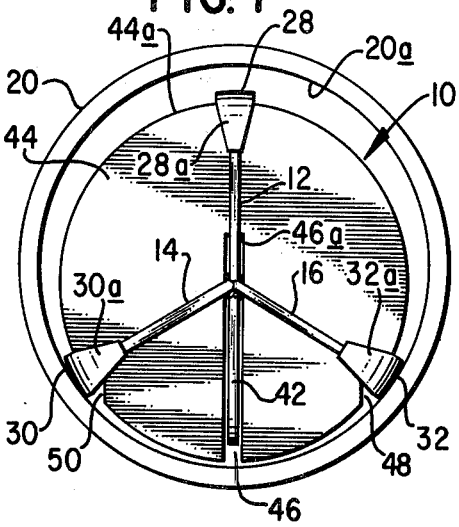
FIG. 7 is an end view of the culvert showing the cleanout device within same.

For additional soil break up, a downwardly depending fourth arm 42 is secured along the central portion of the longitudinal axis 18. The surface area of the sides of arm 42 should be kept to a minimum as to provide a small blade to break up the center of the soil. As illustrated in FIG. 7, arms 14 and 16 engage the inner wall 20*a* of culvert 20 and arm 42 is shorter than arms 14 and 16 and does not engage the bottom of the culvert 20 but does break up the soil between the two arms 14 and 16 where it is generally massed in the greatest density. Arm 42 must be shorter than arms 14 and 16 so as not to engage the bottom of the culvert arm 42 as would cut into tinhorns when used on a culvert constructed of that type of material.

Figure 6:
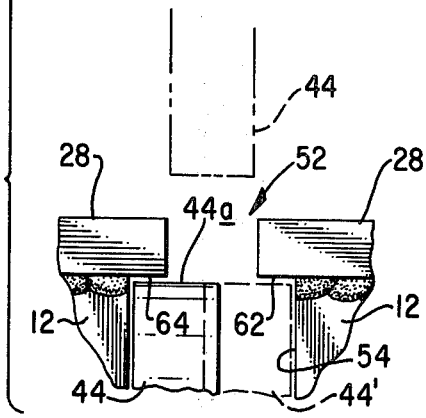
FIG. 6 is an enlarged side elevational view of the disc retainer means.

Means to remove the soil, once the compacted soil has been broken up, generally comprises a generally circular shaped disc 44 having a slot 46 formed therein. Depending on the size of the disc 44 notches 48 and 50 may be formed on the outer edge to clear part of the arms 14 and 16. Disc 44 is slideably disposed through a passage 52 formed in rib 28, and a slot 54 formed in arm 12 in which slot 46 slides over the base portion 54*a* of arm 12 below the slot 54. The outer disc 44 passes through passage 56 formed in arms 14 and 16. Surface 46*a* of slot 46 engages surface 58 of slot 54 to limit downward movement of the disc 44. As best illustrated in FIG. 5, the recesses 48 and 50 are necessary to clear the outer portions 60 of arms 14 and 16 on each side of passages 56. Passages 54 and 56 have a width substantially greater than the thickness of disc 44, whereas passage 52 through rib 28 is substantially equal to the thickness of disc 44 such that a shoulder 62 and 64 is formed on each side of passage 54 and the upper end of said passage 54. As best illustrated in FIG. 6, disc 44 will move against one side of passage 54, or 56 because of the force of the soil depending upon the direction of movement and the upper periphery 44*a* of disc 44 will slide under shoulder 64 as shown in full outline if the device 10 is moving to the right as illustrated in FIG. 6 thus limiting upward movement of disc 44. If the device 10 is moving from the right to the left as illustrated in FIG. 6, the disc 44 will move to the position shown in dashed outline 44' and shoulder 62 will limit upward movement of the disc 44. As illustrated in FIG. 3*a*, smaller disc 44*b* shown in dashed outline may be provided and for removing smaller amounts of soil at one time, and would have slot 46 therein.

The overall circumference formed by the radial arms 12, 14 and 16 should be approximately two inches smaller than the diameter of the culvert 20 being cleaned. A smaller device may be used in any culvert. However, in order to assure adequate clearances the device 10 should be a minimum of two inches smaller in diameter than the culvert 20.

Figure 1:
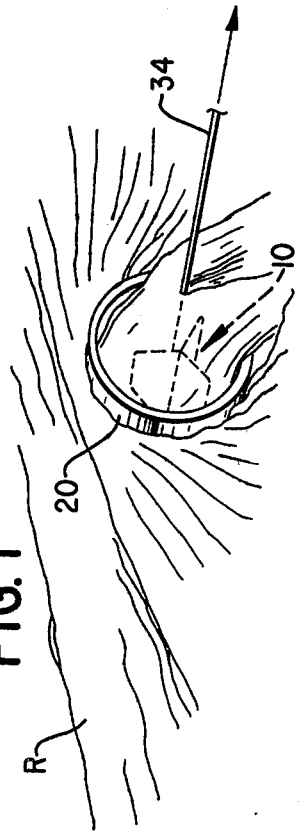
FIG. 1 is a perspective view of the cleanout device within a culvert under a road.

Operation of the hereinbefore described device is as follows:

Culvert 20 generally lies under a road R as illustrated in FIG. 1. A flat sewer tape (now shown) may be used to push through the small opening generally found in the top of culvert 20 when it is loaded with soil. The tape is then attached to a heavy cable 34 which is pulled through the culvert 20. The cleanout device 10 without a disc 44 thereon is then pulled through the culvert to break up the soil. Depending upon the density of the soil, which may contain large amounts of clay and gravel, making it very difficult to break up, the device 10 may have to be pulled back through the culvert 20 several times. However, usually two runs will adequately break up the soil. Since multiple runs are generally necessary, a second cable 65 is attached to the second end of the device 10 to pull it back through.

Figure 2:
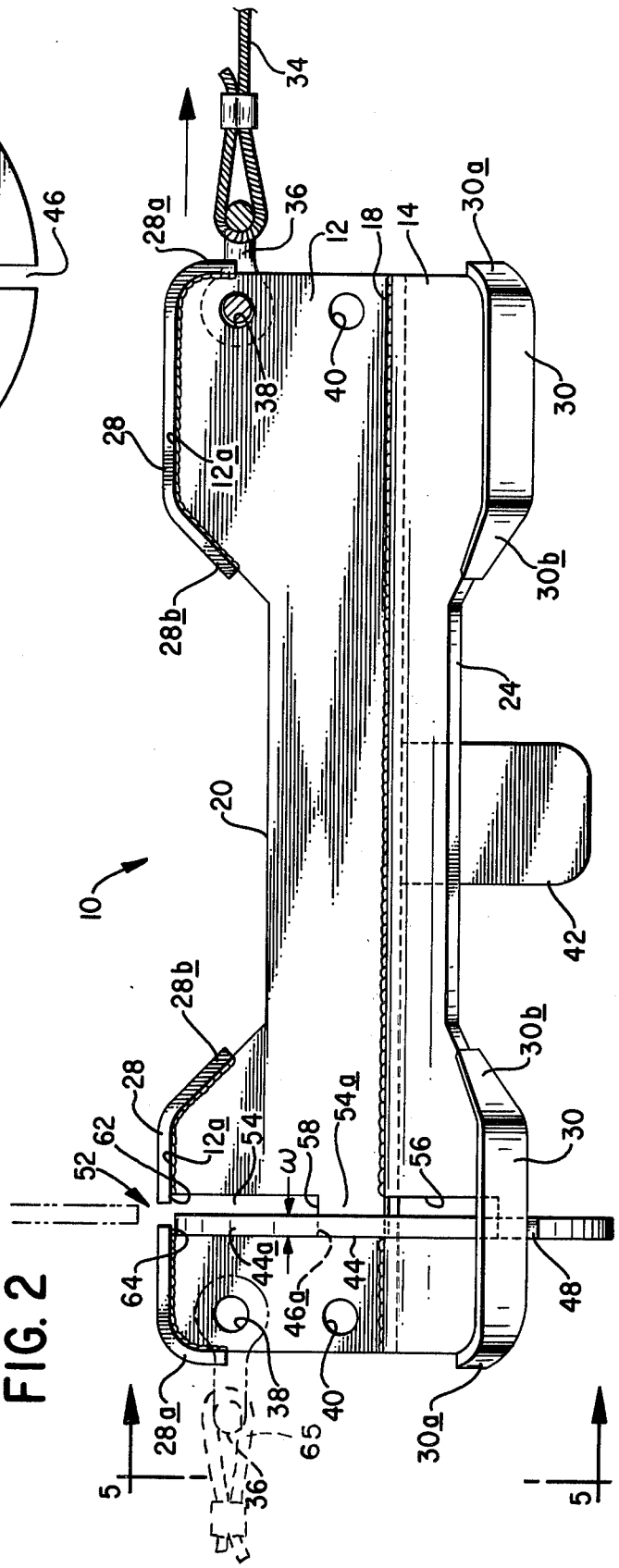
FIG. 2 is a side elevational view of the cleanout device.
Figure 4:
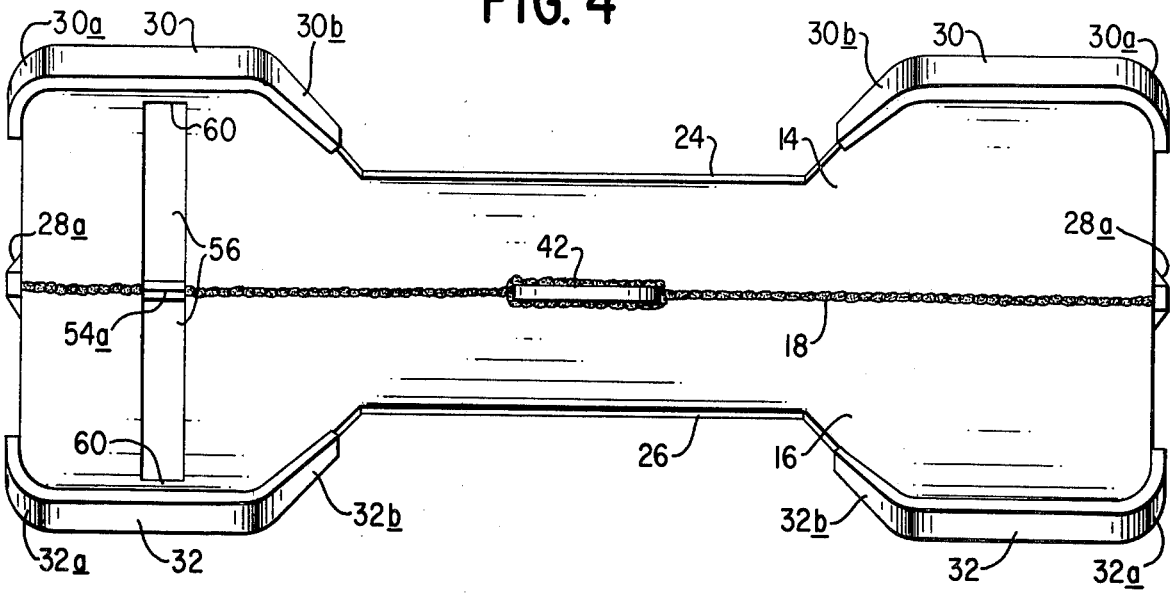
FIG. 4 is a bottom plan view of the cleanout device.

It is possible to start removing the loosened soil with the smaller disc 44*b* from the culvert 20, then the larger disc 44 is positioned in slot 54 as illustrated in FIGS. 2 and 5. The disc 44 is then pulled through, urging the remaining soil from the end of the culvert 20 as illustrated in FIG. 1.

It has been found that generally damp and muddy soil is more easily removed from the culvert than dry, compact clay and gravel.

Because the soil is in a loosened condition, it is possible to start removing the loosened soil with the smaller disc 44*b* attached to the device 10 to pull part of the loosened soil from the culvert 20 as the device 10 is pulled therethrough. A larger disc 44 is then placed in the device 10 to remove the remaining soil.

The recesses 20, 24 and 26 on each of the arms are generally equal to the area on each end of the arm above the bottom ledge of the recess.

In certain situations, four equally spaced arms may be desirable. However, the friction due to the extra area prevents the use of a four armed device in certain applications.

It should be appreciated that culverts having a length of 40–60 feet take only 30 to 60 minutes to completely perform the process.

It should be readily apparent that the heretofore described invention accomplishes the objects of the invention hereinbefore discussed.

It should further be readily apparent that other and further embodiments of the invention may be devised without departing from the basic concept thereof.

Having described our invention, we claim:

1. A culvert cleanout device comprising three equally spaced arms each having an inner edge and an outer edge formed substantially transverse to ends of the arms, said arms being joined at the inner edges to form a central longitudinal axis and extending radially outward relative to said axis, one of said arms being generally vertical and having a hole formed in one end and said vertical arm further having a slot formed inwardly from the outer edge; a rib secured to the outer edges of each of said arms and deflected downwardly over the ends of said arms; means secured in the hole formed in the vertical arm to move said device; and a disc having a slot formed therein is aligned with the slot in the vertical arm, said disc being slideably secured over the vertical arm and transversely to said arms to removably secure said disc to said arms for pushing the loosened soil through a conduit.

2. The combination called for in claim 1 with the addition of: a recess formed in each of the arms from the outer edge inwardly toward the central axis to reduce the surface area of the arms.

3. The combination called for in claim 1 with the addition of: a fourth arm depending downwardly from the central axis, said fourth arm being shorter in length than the length between the inner and outer edges of the first three arms so as not to engage the bottom of the culvert.

4. A culvert cleanout device comprising: three arms having an inner edge and an outer edge extending radially outwardly relative to a longitudinal axis formed at the intersection of the inner edge of the arms, said arms being spaced from each other; a rib secured to the outer edge of each said arms, said flat rib providing a bearing surface, attachment means secured to one end of one of the arms; and a disc having a slot formed therein adapted to be slideably disposed over one of the arms such that the disc extends transverse to the longitudinal axis formed by the arms.

5. The combination called for in claim 4 wherein each arm has a recess formed inwardly from the outer edge.

6. A culvert cleanout device having a plurality of rigid, elongated blades spaced about a central axis, one of said blades having a slot formed transverse to the central axis, means to tow the device through a culvert, the improvement comprising: a rigid circular member having a slot formed from the outer periphery toward the center such that the circular member may be slideably disposed in the slot formed in one of the blades, each of the other blades having a passage formed therein to allow passage of the circular member therethrough such that the circular member is substantially tranverse to the central axis.

7. The combination called for in claim 6 with the addition of: a rib formed over the outer edge of each blade, and a passage formed in the rib secured to the blade having a slot formed therein, said passage in rib aligned with the slot in the blade, to permit passage of said circular member therethrough.

8. The combination called for in claim 7 wherein said slot in one of said blades is wider than the thickness of said circular member and said rib on said blade extends over each side of said slot to form a shoulder on each side of slot in the blade such that the circular member may be moved between the passage formed in the rib and moved to one side of the slot in the blade to limit the outward movement of the circular member.

9. The combination called for in claim 6 wherein the radius of the circular member is substantially equal to the width of the blades.

10. The combination called for in claim 6 wherein the radius of the circular member is less than the width of the blades.

* * * * *